US006722164B1

(12) United States Patent
Ives et al.

(10) Patent No.: US 6,722,164 B1
(45) Date of Patent: Apr. 20, 2004

(54) ELASTIC FABRIC AND METHOD OF MAKING SAME

(75) Inventors: Robert K. Ives, Quitman, GA (US); Larry T. Mitchell, Jr., Thomasville, GA (US)

(73) Assignee: Beech Island Knitting Company, Quitman, GA (US)

( * ) Notice: Subject to any disclaimer, the term of this patent is extended or adjusted under 35 U.S.C. 154(b) by 0 days.

(21) Appl. No.: 09/096,972

(22) Filed: Jun. 12, 1998

Related U.S. Application Data

(62) Division of application No. 08/895,318, filed on Jul. 16, 1997, now Pat. No. 5,765,401.

(51) Int. Cl.[7] ..... D04B 21/00
(52) U.S. Cl. ..... 66/195
(58) Field of Search ..... 66/195, 202, 85 R, 66/196, 172 E, 193; 442/312, 304

(56) References Cited

U.S. PATENT DOCUMENTS

| | | | | | |
|---|---|---|---|---|---|
| 2,747,392 | A | * | 5/1956 | Sadinoff et al. | 66/193 |
| 3,314,251 | A | * | 4/1967 | Bünger | 66/193 |
| 3,710,599 | A | * | 1/1973 | Sarmiento | 66/193 |
| 3,733,859 | A | * | 5/1973 | Wittmann | 66/193 |
| 4,003,224 | A | * | 1/1977 | Odham | 66/193 |
| 4,100,770 | A | * | 7/1978 | Titone | 66/193 |
| 4,215,684 | A | * | 8/1980 | Westip | 66/193 X |
| 4,314,463 | A | * | 2/1982 | Fuchs | 66/203 |
| 4,331,135 | A | * | 5/1982 | Westip | 66/193 X |
| 4,615,186 | A | * | 10/1986 | Rossler | 66/203 |
| 4,631,932 | A | * | 12/1986 | Sommers | 66/193 X |
| 4,817,400 | A | * | 4/1989 | Baesgen et al. | 66/195 |
| 4,895,006 | A | * | 1/1990 | Speich | 66/203 |
| 4,909,049 | A | * | 3/1990 | Baesgen et al. | 66/195 |
| 4,918,947 | A | * | 4/1990 | Speich | 66/203 |
| 5,058,399 | A | * | 10/1991 | Watisse et al. | 66/203 |
| 5,065,601 | A | * | 11/1991 | Kaufmann | 66/195 |
| 5,256,134 | A | * | 10/1993 | Ingham | 66/170 |
| 5,555,750 | A | * | 9/1996 | Fischer et al. | 66/203 X |
| 5,603,132 | A | * | 2/1997 | Zafiroglu | 66/192 |
| 5,632,526 | A | * | 5/1997 | Mclarty, II et al. | 66/192 |

FOREIGN PATENT DOCUMENTS

| | | | | |
|---|---|---|---|---|
| IT | 631932 | * | 1/1962 | 66/193 |

* cited by examiner

*Primary Examiner*—Danny Worrell
(74) *Attorney, Agent, or Firm*—MacCord Mason PLLC

(57) ABSTRACT

An elastic web fabric and method for producing the same. The resulting fabric is curl-free and has bi-directional stretch of between about 50–125% stretch in the width direction and 50–200% stretch in the length direction. In the preferred embodiment, the fabric includes a center marker formed from a two-needle shift of two rubbers to provide a centering line to aid in assembly of a finished article. Also, in the preferred embodiment, the left top edge of the fabric has about six rubbers and the right top edge has about 5 rubbers to prevent curling to produce a fabric which is more easily cut and fabricated into the finished article.

3 Claims, 5 Drawing Sheets

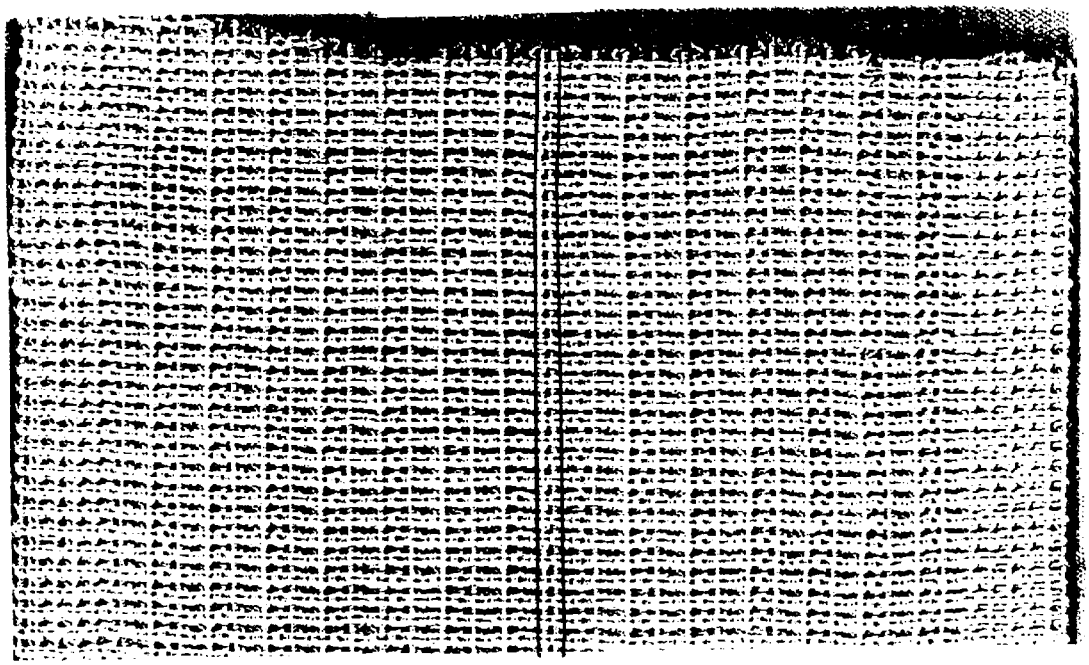
FIG. 4
FIG. 5
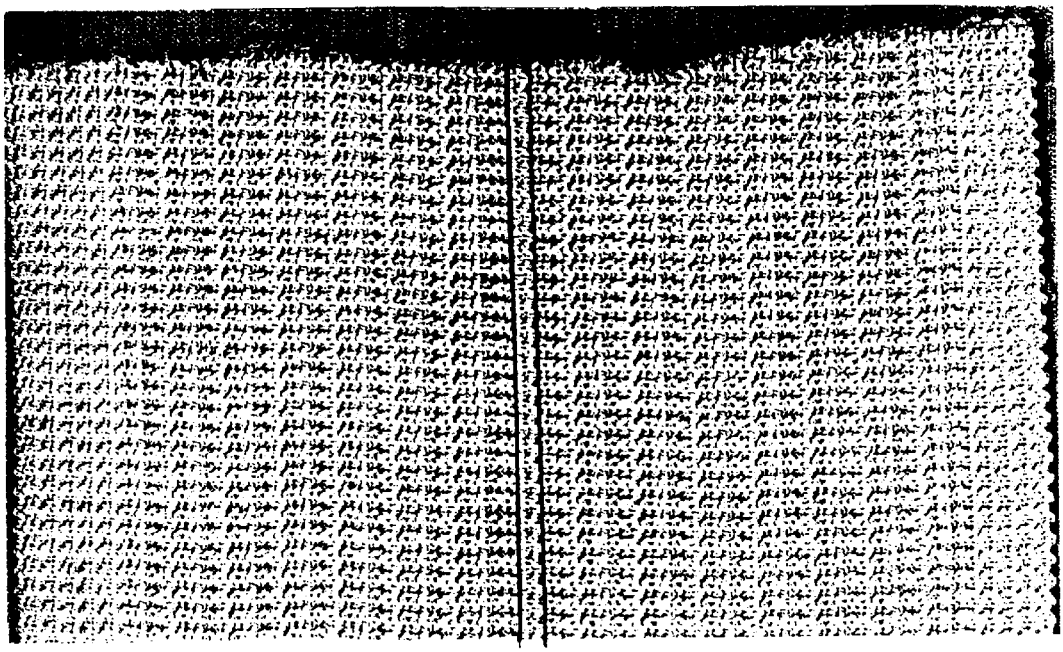

ELASTIC FABRIC AND METHOD OF MAKING SAME

This application is a division of Ser. No. 08/895,318 filed Jul. 16, 1997 now U.S. Pat. No. 5,765,401.

BACKGROUND OF THE INVENTION (1) Field of the Invention

The present invention relates generally to elastic web fabric and, more particularly, to an elastic web fabric with bidirectional stretch suitable for use in orthopedic wrap and athletic supporter pouch fabric.

(2) Description of the Prior Art

Most elastic web fabric manufactured for use in garments such as athletic supporter pouch fabrics are currently produced on a Lamb knitting machine which is a V-bed knitting machine originally developed in the 1920's to produce sweater collars. Such machines operate between 75–100 rpms producing only one piece of fabric per machine. Accordingly, to produce any substantial amount of fabric requires a number of machines operating continuously. On the other hand, modern crochet knitting machines operate substantially faster. For example, a crochet knitting machine can operate as high as 1100 or higher rpm which is over 10 times faster than a Lamb V-bed machine and, at the same time, can produce multiple fabric pieces.

One particularly well-known crochet machine is a Comez 800 Series flat bed knitting machine. While originally introduced in 1977 as the model 805 machine, it has evolved to the model 814 and now is known as the model 816 machine. This machine is available from Comez Machinery of Cilavegna, Italy. However, this machine uses bearded needles because at over about 1100 rpms, latch needles become inoperable. Such needles are not suitable for knitting large diameter elastic yarns as required for the present invention. In addition, material produced on such a machine normally does not have stretch in both the x and y directions and, like most knitted elastomeric material, the edges of the fabric curls.

Thus, there remains a need for a new and improved elastic web knitted fabric and method for producing the same which has bi-directional stretch, is curl-free and ravel resistant and, at the same time, can be produced at a substantially increased rate over conventional V-bed knitting machines and also produce multiple fabric pieces.

SUMMARY OF THE INVENTION

The present invention is directed to an elastic web fabric and method for producing the same which is curl-free and has bi-directional stretch of between about 50–125% stretch in the width direction and 50–200% stretch in the length direction. In the preferred embodiment, the fabric includes a center marker formed from a two-needle shift of two rubbers to provide a centering ,line to aid in assembly of a finished article. Also, in the preferred embodiment, the left top edge of the fabric has about six rubbers and the right top edge has about 5 rubbers to prevent curling to produce a fabric which is more easily cut and fabricated into the finished article.

The fabric according to the present invention is knit on an improved crochet knitting machine normally having bearded needles. The improvement includes replacing the bearded needles with latch needles and adding a latch guide adjacent to the latch needles. A tricot cam is also installed. Finally, the lobes located in the guide pattern wheel of the machine are lengthened to increase the dwell time to prevent two-needle run-on during knitting.

The fabric according to the present invention includes an unique sequence. A first bar of weft yarn, which is the back bar, uses a 1-3/1-3 stitch and moves over two needles and repeats. A second bar, which is the rubber, uses a 1-1/2-2 movement, two on one side of the needle and two on the other side. A third bar of weft yarn, which is the front bar, uses a 1-3/1-5 stitch to prevent weft yarn slippage. The fourth bar, which is the warp yarn, uses a tricot cam which uses an 0-1/1-2 stitch to give a lock stitch chain pattern.

Accordingly, one aspect of the present invention is to provide an improved crochet knitting machine normally having bearded needles. The improvement includes: (a) replacing the bearded needles with latch needles; (b) adding a latch guide adjacent to the latch needles; (c) installing a tricot cam; and (d) lengthening the lobes located in the guide pattern wheel of the machine to increase the dwell time to prevent two-needle run-on during knitting.

Another aspect of the present invention is to provide a knitted elastic fabric. The fabric includes: (a) a first bar of weft yarn, which is the back bar, and uses a 1-3/1-3 stitch and moves over two needles and repeats; (b) a second bar, which is the rubber, and uses a 1-1/2-2 movement, two on one side of the needle and two on the other side; (c) a third bar of weft yarn, which is the front bar, and uses a 1-3/1-5 stitch to prevent weft yarn slippage; and (d) a fourth bar, which is the warp yarn, and uses a tricot cam which uses an 0-1/1-2 stitch to give a lock stitch chain pattern.

Still another aspect of the present invention is to provide a knitted elastic fabric. The fabric being curl-free and having bi-directional stretch of between about 50–125% stretch in the width direction and 50–200 stretch in the length direction.

These and other aspects of the present invention will become apparent to those skilled in the art after a reading of the following description of the preferred embodiment when considered with the drawings.

BRIEF DESCRIPTION OF THE DRAWINGS

FIG. 4 is the top face of a knitted fabric constructed according to the present invention; and FIG. 5 is the bottom face of the knitted fabric shown in FIG. 4.

DESCRIPTION OF THE PREFERRED EMBODIMENTS

Figure 1:
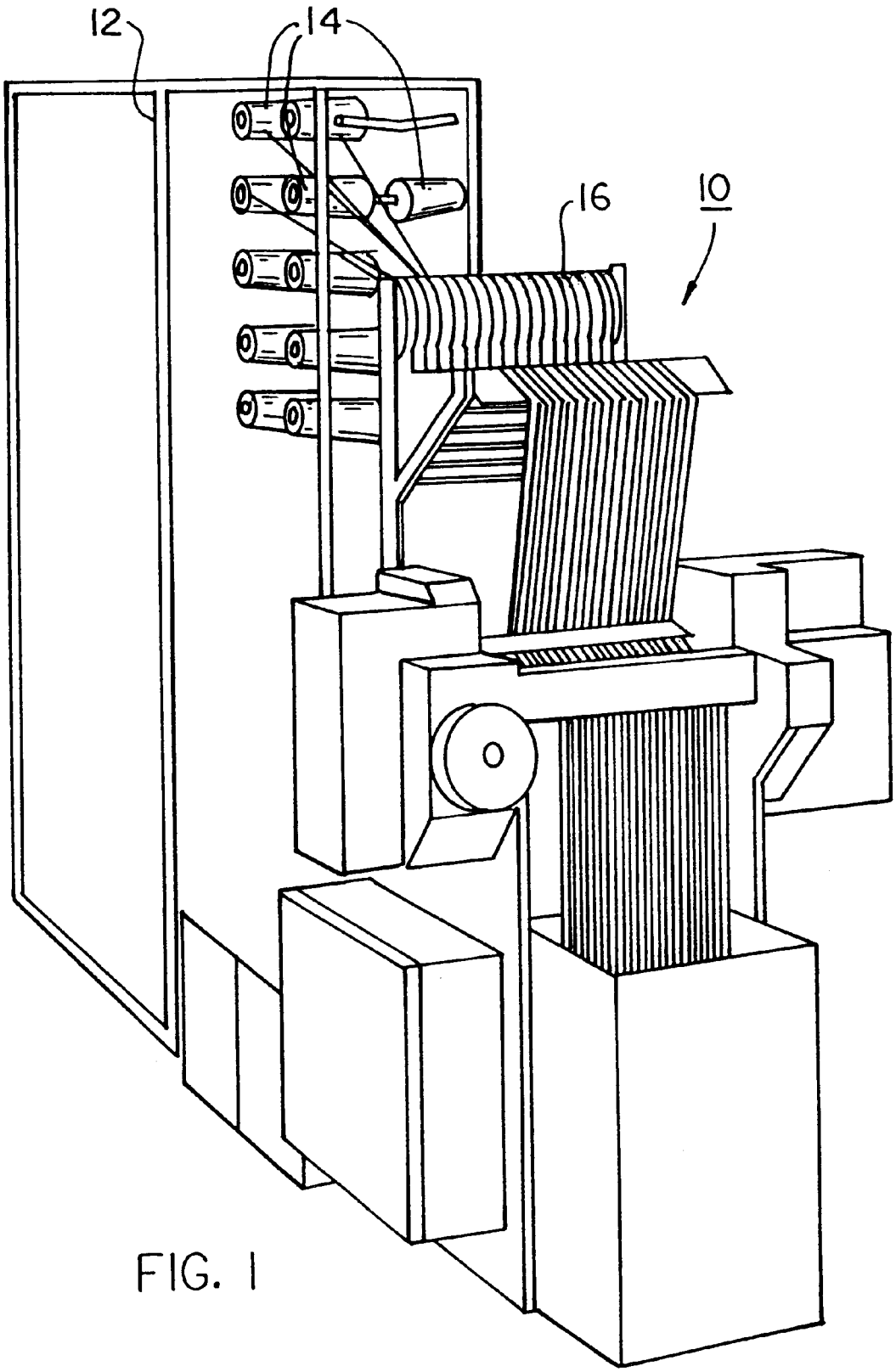
FIG. 1 is front elevational view of a crochet knitting machine constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a crochet machine, generally designated 10, is shown adapted to construct the fabric according to the present invention. The crochet machine 10 includes a creel 12 for supporting a plurality of yarn packages 14 for supplying weft yarn to the machine. Warp yarn is supplied from a beam of yarn ends 16. According to the present invention, the crochet machine 10 is modified to use a tricot cam which is operable to knit on more than one needle to produces an anti-ravel fabric and which has bi-directional stretch since the stitch is not locked all the way across.

Figure 2:
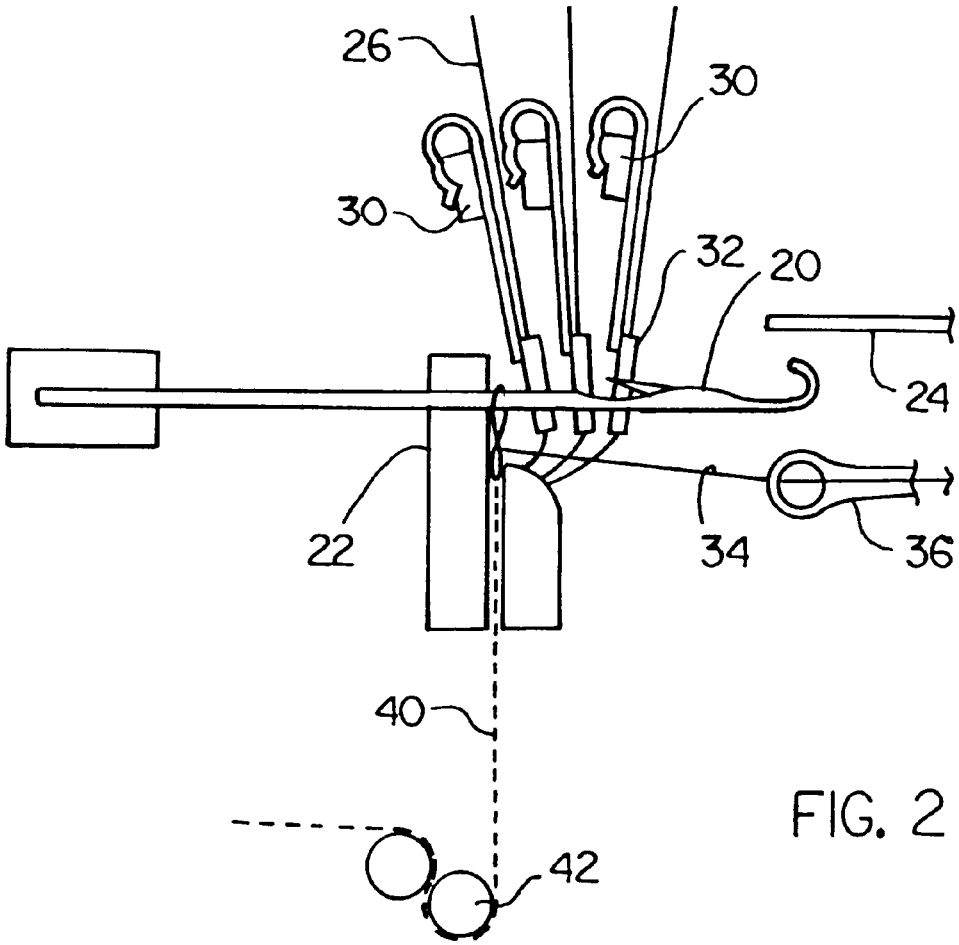
FIG. 2 is an enlarged front elevational view of the machine shown in FIG. 1 utilizing latch needles and latch guides and a lengthened lobe for increased dwell time.
Figure 3A:
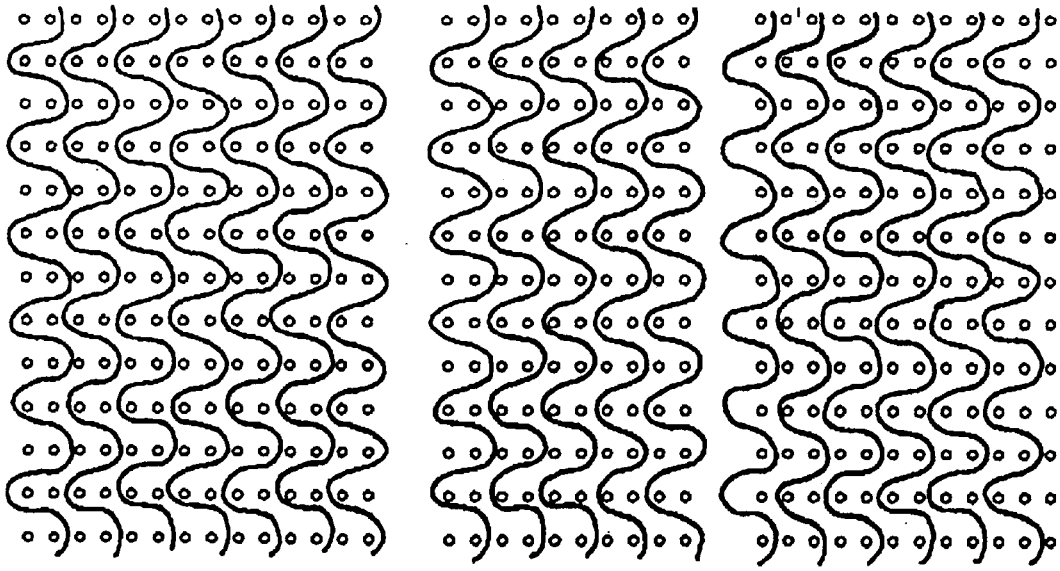
FIG. 3*a* is a stitch diagram illustrating bar number 1—weft yarn.
Figure 3B:
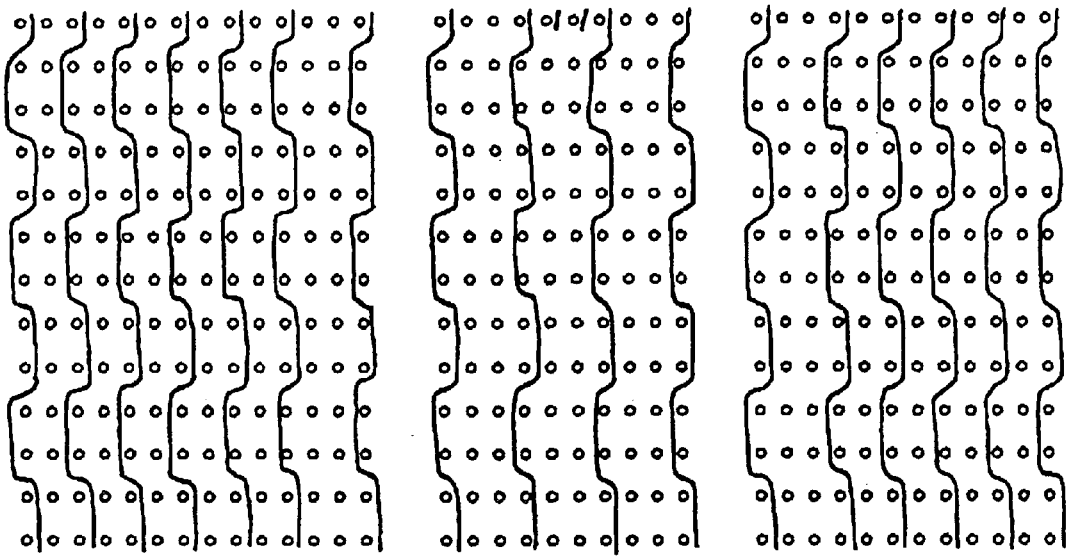
FIG. 3*b* is a stitch diagram illustrating bar number 2—covered rubber yarn.
Figure 3C:
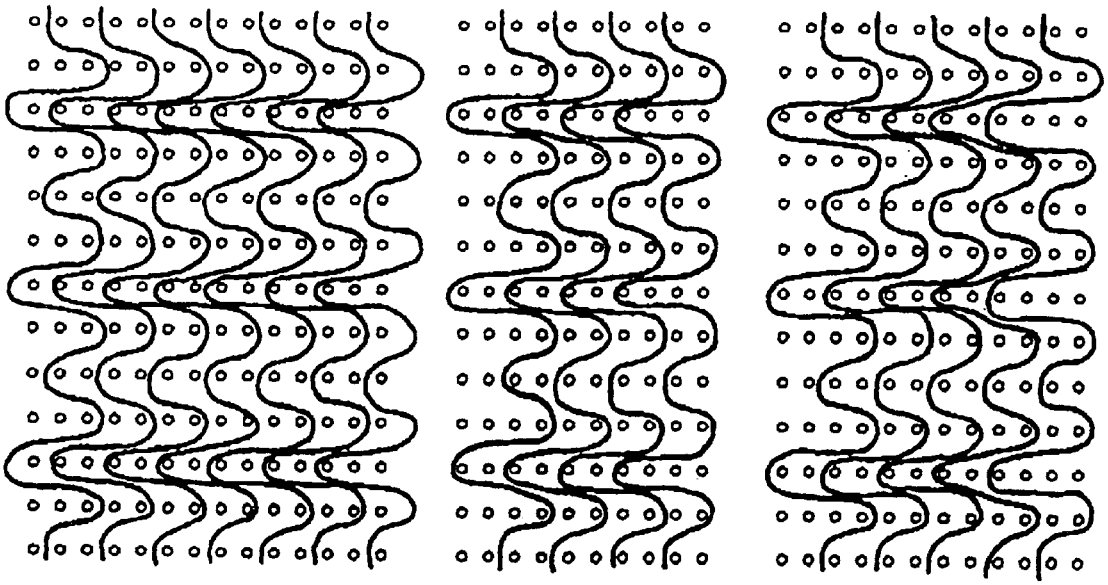
FIG. 3*c* is stitch diagram illustrating bar number 3—weft yarn.
Figure 3D:
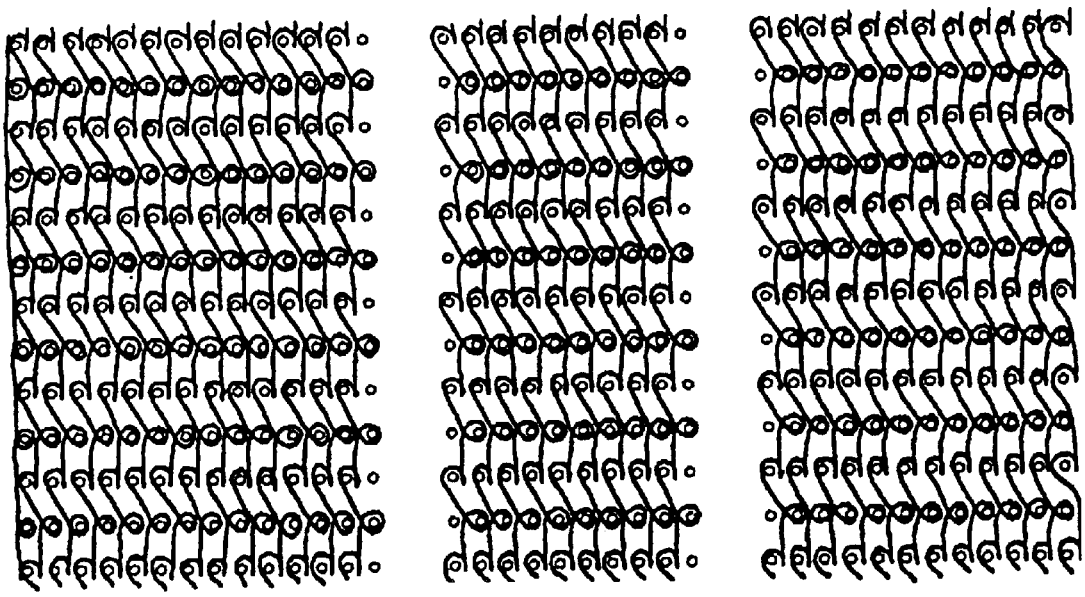
FIG. 3*d* is a stitch diagram illustrating bar number 4—warp yarn.

As can be seen in FIG. 2, the normal bearded needles of a crochet machine have been replaced by latch needles 20, latch guides 22 and a latch bar 24. This modification normally would result in interference in operation and result in broken needles. However, in the present invention, the guide pattern wheels use specially modified lengthened lobes which increases the dwell time to prevent two-needle run-on and needle damage by increasing the dwell from about 18 to about 26 degrees. The remainder of the operation of the crochet machine 10 is generally conventional with the weft threads 26 being fed through the inlay bars 30 and weft tubes 32. The warp yarn 34 is fed through the warp guide 36. The knitted fabric 40 then passes through the fabric take-down rollers 42 where it is then collected.

As best seen in FIGS. 3*a*–3*d*, bar 1 preferably includes either 100% cotton weft having 10 singles or 100% polyester having 200 filaments or a 50/50 blend. Bar 2 is covered rubber which is crocheted with a chain stitch without a weft yarn. Bar 3 is 100% cotton weft with 10 singles or 100% polyester 200-filament or a 50/50 blend similar to bar 1. Finally, bar 4 is a single 150 denier stretch polyester.

As can be seen, bar 1 weft yarn, which is the back bar, uses a 1-3/1-3 stitch. This moves over two needles and repeats. Bar 2, which is the rubber, uses a 1-1/2-2 movement, two on one side of the needle and two on the other side. Bar 3 is the weft front bar and uses a 1-3/1-5 stitch, which prevents weft yarn slippage. Finally, bar 4, which is the warp yarn, uses a tricot cam which uses an 0-1/1-2 stitch to give a lock stitch chain pattern. Preferably, a 92-needle setup is used with 32 ends of rubber. However, 110-needle 40-end rubber and other combinations could also be used.

As best seen in FIGS. 4–5, six rubbers are used on one end, a two-needle shift is used in the center to provide a centering line and five rubbers are used on the right-hand side of the center. These edges using six rubbers on the left and five rubbers on the right are the same width but prevents curling in combination with a balanced upper and top and back face of the fabric. This produces a fabric which is more easily cut and fabricated into a final article. In fact, since the fabric lays flat, this increases the efficiency of assembly up to 30%. In addition, the addition of the center needle pattern acts as a center marker to aid in assembly of the material when used for an athletic supporter or similar garments.

The resulting knitted fabric is ravel-resistant because of the tricot knit, curl-free because of the flex knit and rubber construction, and has 50–125% stretch in the width direction, 50–200% stretch in the length direction. Also, because of the balance of the knit structure, the resulting fabric has a much higher drape value when compared to conventional fabric knitted on a V-bed knitting machine. And, as discussed above, the center marker design allows the fabric to be easily assembled because the closeness of the two rubbers acts as a marker indicating the center of the fabric, especially for producing athletic supporters. After knitting, the yarn is heat-set at 250–300° F. This results in a shrinkage of 3–5% which is acceptable.

In the preferred embodiment, the construction of the elastic web knitted fabric produced according to the present invention includes a fiber content of textured polyester with the elastomer being of extruded or synthetic rubber. The resulting fabric has a bi-directional stretch of 130%±20 and shrinkage in the range less than 5%.

Because of the high output of the modified crochet knitting machine and the improved handleability of the resulting fabric, material constructed according to the present invention is more economical than the prior art fabric, both in manufacture and in assembly.

Certain modifications and improvements will occur to those skilled in the art upon a reading of the foregoing description. By way of example, a variety of deniers or counts of different synthetic or natural yarns may be, substituted. Also, it is expected that additional modifications would allow beard or compound needles to be used. Finally, yarn may be supplied to the needles from the warp or weft positions. It should be understood that all such modifications and improvements have been deleted herein for the sake of conciseness and readability but are properly within the scope of the following claims.

We claim:

1. A flat bed, at least 4 bar knitted elastic fabric, said fabric having bi-directional stretch of between about 50–125% stretch in the width direction and 50–200% stretch in the length direction, wherein said fabric further includes a center marker formed from a two-needle shift of two rubbers to provide a centering line to aid in assembly of a finished article.

2. The fabric according to claim 1, wherein the left top edge of said fabric has about six rubbers and said right top edge has about 5 rubbers to produce a fabric which is more easily cut and fabricated into a finished article.

3. The fabric according to claim 1, further having shrinkage in the range of less than 5%.

* * * * *